United States Patent [19]

Magyar

[11] Patent Number: 4,670,171

[45] Date of Patent: Jun. 2, 1987

[54] SURFACE CLEANER COMPOSITION

[75] Inventor: Arpad M. Magyar, Conroe, Tex.

[73] Assignee: Pennzoil Company, Houston, Tex.

[21] Appl. No.: 705,604

[22] Filed: Feb. 26, 1985

[51] Int. Cl.[4] ..... C11D 3/07; C11D 3/43

[52] U.S. Cl. ..... 252/529; 252/153; 252/531; 252/532; 252/539; 252/90; 252/DIG. 14

[58] Field of Search ..... 252/529, 531, 532, 539, 252/DIG. 14, 540, 106, 153, 90

[56] References Cited

U.S. PATENT DOCUMENTS

| | | | |
|---|---|---|---|
| 3,032,505 | 5/1962 | Glynn | 252/122 |
| 3,591,509 | 7/1971 | Parks et al. | 252/532 |
| 3,591,510 | 7/1971 | Zenk | 252/532 |
| 3,609,089 | 9/1971 | Cantrell et al. | 252/137 |
| 3,634,268 | 1/1972 | Karg | 252/529 |
| 3,709,825 | 1/1973 | Chirash et al. | 252/158 |
| 3,882,038 | 5/1975 | Clayton et al. | 252/164 |
| 4,087,387 | 5/1978 | Willems et al. | 252/524 |
| 4,124,520 | 11/1978 | Schwalley et al. | 252/106 |
| 4,140,647 | 2/1979 | Mizutani et al. | 252/89 |
| 4,228,043 | 10/1980 | van den Brom | 252/529 |
| 4,255,294 | 3/1981 | Rudy et al. | 252/524 |
| 4,302,348 | 11/1981 | Requejo | 252/135 |
| 4,312,771 | 1/1982 | Matsuda | 252/107 |
| 4,397,755 | 8/1983 | Brierley et al. | 252/113 |
| 4,485,028 | 11/1984 | King | 252/99 |
| 4,490,270 | 12/1984 | Hackett et al. | 252/106 |

FOREIGN PATENT DOCUMENTS

| | | |
|---|---|---|
| 1533390 | 11/1979 | United Kingdom . |
| 595371 | 2/1978 | U.S.S.R. . |

*Primary Examiner*—Prince E. Willis

*Attorney, Agent, or Firm*—Lowe, Price, Leblanc, Becker & Shur

[57] ABSTRACT

Detergent compositions for use in cleaning automotive surfaces, particularly whitewall tires, vinyl tops, and upholstery fabric material, comprise a sequestering agent, a wetting agent, a surfactant, a penetrant, a foam booster, and optionaly a perfume and/or coloring agent in an aqueous carrier. The composition is preferably placed in brush top aerosol cans for use as a cleaner.

12 Claims, No Drawings

SURFACE CLEANER COMPOSITION

FIELD OF THE INVENTION

This invention relates to a composition useful for cleaning surfaces such as vinyl car tops, whitewall tires, vinyl and fabric interiors, and other difficult to clean automotive surfaces, and containers such as aerosol cans equipped with brush tops containing said composition.

BACKGROUND OF THE INVENTION

A great deal of effort has been expended in efforts to develop cleaning compositions for automotive surfaces, in particular whitewall tires and vinyl tops, which would efficiently remove road film from these surfaces. Road film is a mixture of dirt, fuel residues, lubricant residues, soot, and any other material which settles on the vehicle from the air or is picked up from roads. Generally, road film is very difficult to clean. Further, detergent compositions formulated for this purpose must be strong enough to remove the road film without harming the particular automotive surface to which they are applied. For example, the detergent composition must be able to clean road film from vinyl tops without dulling the surface thereof.

Prior art detergent compositions are known which contain components similar to the composition of the present invention. For example, U.S. Pat. No. 4,228,043 to van den Brom, issued on Oct. 14, 1980, discloses a liquid detergent composition containing an organic sulfonate, a sulfated alcohol salt, a fatty acid amide, a tripolyphosphate, an orthophosphate, a metal carbonate, a dye, perfume, and preservative, and water.

U.S. Pat. No. 4,255,294 to Rudy et al, issued Mar. 10, 1981, discloses a fabric softening composition containing a sulfonate, a tripolyphosphate, a carboxymethyl cellulose, a fatty acid amide, a sulfate, an organic sulfonate, a silicate, a dye and preservative, and water.

Matsuda, U.S. Pat. No. 4,312,771, issued Jan. 26, 1982, discloses a liquid soap composition comprising a fatty acid, a fatty acid amide, propylene glycol, glycerine, a fungicide, a pearling agent, a dye and a perfume.

No compositions are known however which contain applicant's unique combination of components and utility for cleaning surfaces which require good but non-injurious cleaning.

SUMMARY OF THE INVENTION

It is therefore an object of this invention to provide a detergent composition for use on automotive surfaces, in particular whitewall tires, vinyl tops, and vinyl and fabric interiors.

It is also an object of this invention to provide a container such as an aerosol can equipped with a brush top and filled with the detergent composition of the present invention.

Other objects and advantages of the invention will become apparent as the description thereof proceeds.

In satisfaction of the foregoing objects and advantages, the present invention provides a detergent composition for use in cleaning automotive surfaces, particularly whitewall tires and vinyl tops, comprising from 1 to 10 weight percent of a sequestering agent, from 1 to 10 weight percent of a wetting agent, 1–10 weight percent of a surfactant, 0.5 to 5 weight percent of a penetrant, 0.1 to 6 weight percent of a foam booster, and the balance an aqueous carrier.

The present invention further provides containers such as aerosol containers equipped with a brush top, and filled with the composition of the present invention.

DETAILED DESCRIPTION OF THE INVENTION

The present invention is directed to a detergent composition which comprises the following formulation:

| Component | Amount Wt. % |
|---|---|
| Sequestering Agent | 1–10 |
| Wetting Agent | 1–10 |
| Surfactant | 1–10 |
| Penetrant | 0.5–5 |
| Foam Booster | 0.1–6 |
| Aqueous Carrier | Balance |

The composition may optionally contain about 0.01 to 0.10 weight percent of a perfume or deodorant, and about 0.001 to 0.1 of a dye or an optical brightening agent for making the cleaned surface lighter and more pleasing to the eye.

The present invention also relates to an aerosol can having a brush top which is filled with the composition of the present invention.

The detergent composition is applied to automotive surfaces, in particular whitewall tires, vinyl tops and vinyl and fabric interiors to remove built-up road film therefrom. The composition has a significant advantage over prior art compositions for use in cleaning road film and other hard to remove grease and grime from automotive surfaces in that, while the composition effectively removes the road film and other tenacious contaminants from said surfaces, it is non-corrosive and has a pH in the neutral range. Therefore, the composition will not corrode the automotive surfaces to which it is applied and also will not injure the user's hands or clothing.

The composition is preferably used by placing in a brush top aerosol can from which it may be sprayed onto the automotive surface. Upon release of the composition from the can, it will emerge through the brush as a foam, and can therefore be brushed into the surface to be cleaned.

As set forth hereinabove, the composition contains 1 to 10 weight percent of a sequestering agent. The sequestering agent is a neutral agent, which reacts with metal ions in the composition to prevent the ions from forming undesirable reaction products and is an alkali metal condensed phosphate. The preferred sequestering agent of the present invention is potassium tripolyphosphate which also acts as a buffer and detergent, and has a dirt dispersing effect. Other phosphate sequestering agents which may be used include sodium and tripolyphosphate, tetrasodium and tetrapotassium pyrophosphates, and sodium and potassium hexametaphosphates and mixtures.

The composition also contains 1 to 10 weight percent of a wetting agent. The wetting agent acts to lift dirt. The preferred wetting agent of the present invention is an ethylhexylalcoholsulfate. The preferred ethylhexylalcoholsulfate used in the present invention is Emersal® 6465, which is available from Emery Industries, Inc. In general the wetting agents which may be used include the alkali metal (sodium and potassium) salts of fatty acid sulfates and sulfonates having from 8–18 carbons in the fatty acid group, and lower alkylbenzene sulfonates having from 1–3 carbons in a lower alkyl group. The preferred lower alkyl benzene sulfonates include xylene, toluene, ethylbenzene, and isopropylbenzene sulfonates. Sulfonates made from xylene include orthoxylene sulfonate, metaxylene sulfonate, paraxylene sulfonate, and ethylbenzene sulfonate.

The surfactant used in the composition of the present invention is present in the detergent composition in an amount from about 1–10 weight percent, and functions to enable the dirt and other components of the road film to be washed out of the surface being treated. The preferred surfactants of the present invention are polyoxyethylated surfactants, such as polyoxyalkylated sulfates and sulfonates, and polyoxyalkylated nonyl, octyl, or isooctyl phenols. In particular, Triton X-100® and Triton X-102®, which may be obtained from Rohm and Haas Company, and Stepanate X®, a xylene sulphonate which may be obtained from the Stepan Chemical Company, are preferred.

Auxiliary surfactants may be included in the composition such as 1 to 10 wt. % of alkyl benzene sulfonate having 8 to 18 carbon atoms in the alkyl group.

The penetrant, which functions to penetrate the road film such that the dirt may be dislodged from the automotive surface is present in the composition in an amount from 0.5 to 5 weight percent. The preferred penetrant is a propylene glycol or derivative thereof, either propylene glycol monomethyl ether in the presence or absence of dipropylene glycol monomethyl ether, although other glycols, such as ethylene glycol monobutyl ether, diethylene glycol monobutyl ether, or mixtures thereof may also be used. Preferred penetrants include Butyl Cellosolve®, which may be obtained from Union Carbide, and Ektrasolve EP® (ethylene glycol monopropyl ether) which may be obtained from Eastman Chemical Products.

A foam booster is present in the present invention from 0.1 to 6 weight percent, which causes the detergent composition to foam upon being released from its container. The preferred foaming agent is a fatty acid amide. The preferred foam boosters of the present invention are Monamid 150-ADD®, which is formed by the reaction of a coconut fatty acid with a diethanol amine, and may be obtained from Mona Industries, Inc, and Miranol DEA®, an amphoteric surfactant foaming agent which may be obtained from the Miranol Chemical Company.

The balance of the essential composition comprises an aqueous carrier, in particular water, but which may also contain other solvents such as lower alkyl alcohols.

Optionally, a deodorant and/or coloring agent may be present in the composition. The deodorant is preferably an industrial odorant or perfume. The preferred deodorant of the present invention are Deodall #1®, available from Givaudan Corp., and Pine Oil. The deodorant should be present in an amount from 0.01 to 0.10 weight percent for best results. Further, a water soluble coloring agent may also be present. The agent may be a dye, preferably green or blue dye, or an optical brightener. The particular dye of the present invention is Acid Green No. 2®, which may be obtained from E. F. DuPont de Nemours. The dye or optical brightener may be present in the composition in an amount from 0.001 to 0.1 weight percent.

In a preferred embodiment, the detergent composition is placed in a brush top aerosol can using a conventional propellant, and used to clean automotive surfaces. When released from the can, the detergent will emerge as a foam through the brush top of the can. In an alternate embodiment, the brush may have a sponge in the middle thereof, and the foam will emerge through the sponge. The foam can then be brushed onto the surface to be cleaned. The detergent foam penetrates the surface of the road film, and dislodges the dirt from the particular automotive surface. The dirt is lifted into the foam, discoloring the suds. The dirt and road film constituents may then be removed by rinsing the suds with water, or by rubbing with a moist cloth, the latter method especially suitable for cleaning fabric surfaces.

The composition of the present invention is prepared as follows. The sequestering agent is first dissolved in the aqueous carrier. Then, the wetting agent is dissolved, followed by dissolution of the surfactant, penetrant, and foam booster in that order. Optionally, a perfume and/or dye is then dissolved in the composition. A clear liquid product is formed, having a blue or green color if a dye is used.

In the preferred embodiment of the present invention, the composition has the following reagents:

| Component | Amount |
|---|---|
| Sequestering Agent | 3–6 wt. % |
| Wetting Agent | 3–6 wt. % |
| Surfactant | 3–6 wt. % |
| Penetrant | 1–4 wt. % |
| Water | 78–90 wt. % |
| Foam Booster | 0.1–6 wt. % |

The following examples are presented to illustrate the invention but it is not to be considered as limited thereto. In the examples and throughout the specification, parts are by weight unless otherwise indicated.

EXAMPLE 1

A formulation containing the following components was prepared:

84.45 wt. % deionized water
4.30 wt. % potassium tripolyphosphate
4.20 wt. % Emersal 6465®
4.00 wt. % Triton X-100®
1.00 wt. % Dipropylene Glycol Monomethyl Ether
1.00 wt. % Propylene Glycol Monomethyl Ether
1.00 wt. % Monamid 150-ADD
0.05 wt. % Deodall #1®
0.01 wt. % Green or blue water soluble dye The potassium tripolyphosphate was first dissolved in the water. The remaining ingredients were then dissolved in the order described above, with agitation. A clear blue or green liquid product was formed.

EXAMPLE 2

The product of Example 1 was filled into brush top aerosol cans with a propellant. The composition was released from the cans and applied to automotive surfaces. The experimental product was evaluated on several very dirty whitewall tires and vinyl car tops, and on soiled upholstery surfaces. It was found to remove dirt quickly and efficiently with little scrubbing effort. The dirt was lifted into the foam, discoloring the suds, in a short period of time. Then the foam was rinsed from the automotive surfaces, leaving said surfaces clean. There was no chalking or other apparent deterioration of the surfaces cleaned. Dislodged dirt and grime were easily wiped off the fabric materials with a moist cloth following the brush-cleaning operation. The nearly neutral product was non-corrosive to the skin.

EXAMPLE 3

A formulation containing the following components was prepared:
82.00 wt. % deionized water
4.30 wt. % potassium tripolyphosphate
4.20 wt. % Emersal 6465®
4.00 wt. % Triton X-100®
2.00 wt. % Butyl Cellosolve®
2.00 wt. % Miranol DEA®
1.00 wt. % Monamid 150-ADD
0.50 wt. % Pine Oil
0.01 wt. % blue water soluble dye
The formulation was blended as in example 1.

EXAMPLE 4

The product of Example 3 was filled into brush top aerosol cans with a propellant. The composition was tested in a way similar to that of example 2. The product provided quick and efficient cleaning action on white-wall tires, vinyl tops, and upholstery. The product was not irritating to the operator's skin and caused no deterioration of any of the surface it was applied to.

EXAMPLE 5

A formulation containing the following components was prepared:
84.43 wt. % deionized water
4.30 wt. % potassium tripolyphosphate
4.20 wt. % Emersal 6465®
4.00 wt. % Triton X-100®
2.00 wt. % Butyl Cellosolve®
1.00 wt. % Monamid 150-ADD
0.05 wt. % Deodall #1
0.02 wt. % green dye

EXAMPLE 6

The product of Example 5 was filled into brush top aerosol cans with a propellant. The product showed good sudsing and cleaning performance in all tests conducted according to examples 2 and 4.

EXAMPLE 7

A formulation containing the following components was prepared:
84.43 wt. % deionized water
4.30 wt. % potassium tripolyphosphate
4.20 wt. % Stepanate X®
4.00 wt. % Triton X-100®
2.00 wt. % Ektasolve EP®
1.00 wt. % Monamid 150-ADD
0.05 wt. % Deodall #1
0.02 wt. % blue water soluble dye

EXAMPLE 8

Tests performed on this formulation provided similar results to those of Examples 2,4 and 6. The lower level of odor associated with the ethylene glycol monopropyl ether provided a cleaner smelling product than the ones made with butyl cellosolve.

EXAMPLE 9

A formulation containing the following components was prepared:
77.49 wt. % deionized water
4.00 wt. % potassium tripolyphosphate
4.00 wt. % Emersal 6465®
10.00 wt. % Triton X-100®
3.00 wt. % Miranol DEA®
1.50 wt. % Monamid 150-ADD
0.05 wt. % Deodall #1
0.01 wt. % blue water soluble dye

EXAMPLE 10

This product performed quite well when tested on automotive surfaces, gave good foaming action; however, it was rated inferior to the previously described formulations. Even though this formulation contained more than twice the level of the surfactant Triton X-100®, omitting the glycol ether penetrant component provided a diminished cleaning action.

The invention has been described herein with reference to certain preferred embodiments. As obvious variations will be become apparent to those skilled in the art, the invention is not to be considered as limited thereto.

What is claimed is:

1. A non-corrosive detergent composition for cleaning automotive surfaces, comprising:

1 to 10 weight percent of a neutral sequestering agent for reacting with metal ions contained in the composition, said neutral sequestering agent comprising an alkali metal condensed phosphate;

1 to 10 weight percent of a wetting agent selected from the group consisting of alkali metal salts of fatty acid sulfates and sulphonates having from 8 to 18 carbons in the fatty acid group, lower alkylbenzene sulfonates having from 1 to 3 carbons in the lower alkyl group, and ethylhexylalcoholsulfate;

1 to 10 weight percent of a surfactant selected from the group consisting of polyoxyethylated sulfates and sulfonates and polyoxyethylated nonyl, octyl and isooctyl phenols;

0.5 to 5 weight percent of a penetrant for penetrating a dirt film on the surface to be cleaned, said penetrant being selected from the group consisting of propylene glycol, propylene glycol monomethyl ether, dipropylene glycol monomethyl ether, ethylene glycol monobutyl ether, diethylene glycol monobutyl ether, ethylene glycol monopropyl ether and mixtures thereof;

0.1 to 6 weight percent of a foam booster for providing a foaming action upon application of the composition on a surface comprising a fatty acid amide; and the balance an aqueous carrier, said composition having a pH in the neutral range.

2. A composition according to claim 1 wherein the sequestering agent is potassium tripolyphosphate.

3. A composition according to claim 1 wherein the wetting agent is ethylhexylalcoholsulfate.

4. A composition according to claim 1 wherein the penetrant is a propylene glycol alkyl ether derivative.

5. A composition according to claim 1, wherein the penetrant is selected from the group consisting of propylene glycol monomethyl ether, dipropylene glycol monomethyl ether, and mixtures thereof.

6. A composition according to claim 1 which further contains 0.01 to 0.10 weight percent of a perfume.

7. A composition according to claim 1 wherein the composition further contains a water soluble dye in an amount from 0.001 to 0.10 weight percent.

8. A composition according to claim 7 wherein the water soluble dye is an optical brightener.

9. A composition according to claim 1 wherein the aqueous carrier is water.

10. A detergent composition according to claim 1, comprising 3–6 wt. percent of said neutral sequestering agent, 3–6 wt. percent of said wetting agent, 3–6 wt. percent of said surfactant, 1–4 wt. percent of said penetrant and 78–90 wt. percent water.

11. An article of manufacture comprising an aerosol can containing the detergent composition of claim 1 and a propellant.

12. A detergent composition comprising:

deionized water;

potassium tripolyphosphate;

2-ethylhexylalcoholsulfate;

a polyoxyethylated surfactant selected from the group consisting of polyoxyethylated nonyl, octyl and isooctyl phenols;

a penetrant selected from the group consisting of propylene glycol, dipropylene glycol monomethyl ether, propylene glycol monomethyl ether, ethylene glycol monobutyl ether, diethylene glycol monobutylether, ethylene glycol monopropyl ether and mixtures thereof;

coconut fatty acid diethanolamide;

perfume; and water soluble dye, said composition having a pH in the neutral range.

* * * * *